US008140201B2

(12) United States Patent
Meyer

(10) Patent No.: US 8,140,201 B2
(45) Date of Patent: Mar. 20, 2012

(54) VITAL METHOD FOR EXITING AND RE-ENTERING A MAPPED GUIDEWAY TERRITORY

(75) Inventor: Gerhard F. Meyer, Oceanside, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 504 days.

(21) Appl. No.: 12/356,604

(22) Filed: Jan. 21, 2009

(65) Prior Publication Data

US 2009/0184213 A1 Jul. 23, 2009

Related U.S. Application Data

(60) Provisional application No. 61/021,849, filed on Jan. 17, 2008.

(51) Int. Cl.
*G05D 1/00* (2006.01)

(52) U.S. Cl. ..... 701/19

(58) Field of Classification Search ..... 701/19, 701/20, 213; 246/20, 21, 22, 27, 28 R, 131–135, 246/160

See application file for complete search history.

(56) References Cited

U.S. PATENT DOCUMENTS

2004/0140405 A1 7/2004 Meyer
2005/0010338 A1 * 1/2005 Kraeling et al. ..... 701/19

FOREIGN PATENT DOCUMENTS

DE 102004057907 A1 6/2006
EP 0836978 A1 4/1998

OTHER PUBLICATIONS

Abaz, Lejla, "AU Application No. 2009205894 Office Action Mar. 28, 2011"Publisher: IPA, Published in: AU.
Milius, Birgit, "Interlockings for Tomorrow: How to integrate interlockings in ETCS Level 3 Systems", "ZEVrail Glasers Annalen", Jan. 1, 2002, pp. 106-114, vol. 126, No. 2/03, Publisher: Georg Siemens Verlag, Berlin, DE, Published in: DE.
Massalski, Matthias, "PCT Application No. PCT/US2009/031562 International Search Report Apr. 29, 2009"Publisher: EPO, Published in: EP.

* cited by examiner

*Primary Examiner* — S. Joseph Morano
*Assistant Examiner* — Robert McCarry, Jr.
(74) *Attorney, Agent, or Firm* — DeMont & Breyer, LLC

(57) ABSTRACT

A system and method for controlling a train in a manner that accommodates transitions from and to railway-controlled territory at designated locations, as well as operating within the proximity of those locations in a vital manner.

9 Claims, 6 Drawing Sheets

VITAL METHOD FOR EXITING AND RE-ENTERING A MAPPED GUIDEWAY TERRITORY

STATEMENT OF RELATED CASES

This case claims priority of U.S. Provisional Patent Application 61/021,849, which was filed Jan. 17, 2008 and is incorporated herein by reference.

FIELD OF THE INVENTION

The present invention relates to railway systems in general, and, more particularly, to train control systems for exiting and entering mapped territory.

BACKGROUND OF THE INVENTION

Vital train control systems rely on precise train-location determination, which is performed using an onboard track map in conjunction with GPS. During the course of operations, a train will often leave "controlled territory" and enter an industrial spur or branch track that is not owned or controlled by the operating railroad. Although all railroad-controlled track is mapped (and appears in the track map), industrial track in the vicinity of the railroad-controlled track is not necessarily mapped. This is due to cost considerations and the fact that the operating railroad does not own or control the industrial track.

Although the unmapped industrial track will not, of course, appear in the track map, the train control system must nevertheless support train operations where the train exits controlled territory, operates within the proximity of the point of exit, (e.g., on an industrial spur or branch track), and returns to controlled territory where all functions and features are enforced in a vital manner.

SUMMARY OF THE INVENTION

The present invention provides a system and method for controlling a train in a manner that accommodates transitions from and to controlled territory at designated locations as well as operation within proximity of those locations in a vital manner.

In accordance with the illustrative embodiment, an onboard control system recognizes that the train is exiting controlled territory at a designated point. The system assumes that the train will operate off territory and may later return to that point. While the train is operating off mapped track, the onboard control system determines the train's operating speed and enforces a designated off-territory ("spur") speed limit. The speed limit is enforced using sensor data but without the benefit of mapped track.

The control system also possesses a capability to:

- retain mandatory directives while operating off territory;
- accept newly issued directives in a vital manner while operating off territory; and
- enforce directives upon the approach and return to controlled territory.

Retention of data avoids the retransmission of vital data, re-entry of prior data input by the crew, and preserves communications bandwidth.

A return to controlled track at or near the designated exit point must be detected at a distance greater than the estimated braking distance. This ensures that the train does not attempt to enter controlled territory in an unsafe manner (i.e., without authority or over an unsafe route).

The onboard control system evaluates its current position and the potential controlled-territory entry points nearby (as defined in the track map). The system then determines that a territory re-entry maneuver is taking place at the point from which it exited or at another point in proximity thereto. This determination is performed with minimal or no crew input. The onboard control system also makes the determination that the train is leaving territory once the distance from the exit point exceeds a threshold. At that point, the control system ceases operating in the aforedescribed special operating mode.

The illustrative system and method facilitates re-entry into controlled territory in a vital manner. It eliminates the need for track mapping and database maintenance into each adjoining piece of uncontrolled track. Furthermore, it provides a measure of over-speed protection while the train is off-territory.

DETAILED DESCRIPTION

The following terms are defined below for use in this disclosure and the appended claims:

"Vital" means that a function must be done correctly, or the failure to do so must result in a safe state. Vital is synonymous with "safety-critical." A safety-critical system is defined when at least one identified hazard can lead directly to a mishap (accident). Standard 1483 (http://shop.ieee.org/ieeestore/) defines a safety-critical system as one where the correct performance of the system is critical to the safety, and the incorrect performance (or failure to perform the function) may result in an unacceptable hazard. According to most standards, hazards that have risk ratings of "Unacceptable" or "Undesirable" must be mitigated (i.e., reduce the risk, which is generally done by decreasing the frequency of occurrence) through system and equipment design. In order to do this, all of the functions that are necessary to implement the system must be identified. Functions that have to be implemented so that they are both (1) performed and (2) performed correctly are implemented fail-safely and are identified as "vital" functions. The fail-safely implementation means that all credible failures that could occur are examined and the occurrence of any one of them (or combination of failures in the event that the first failure is not self-evident) maintains the system in a safe state. That can be done either by forcing the system to a stop (or other safe state such as a less-permissive signal) or by transferring control to a secondary system, such as a redundant computer.

"OTC" means optimized train control. OTC combines data communications, train movement and positioning systems, as well as onboard computers tied to locomotive control systems to enhance visibility of network operating conditions and provide safer and more efficient train operations.

Figure 1:
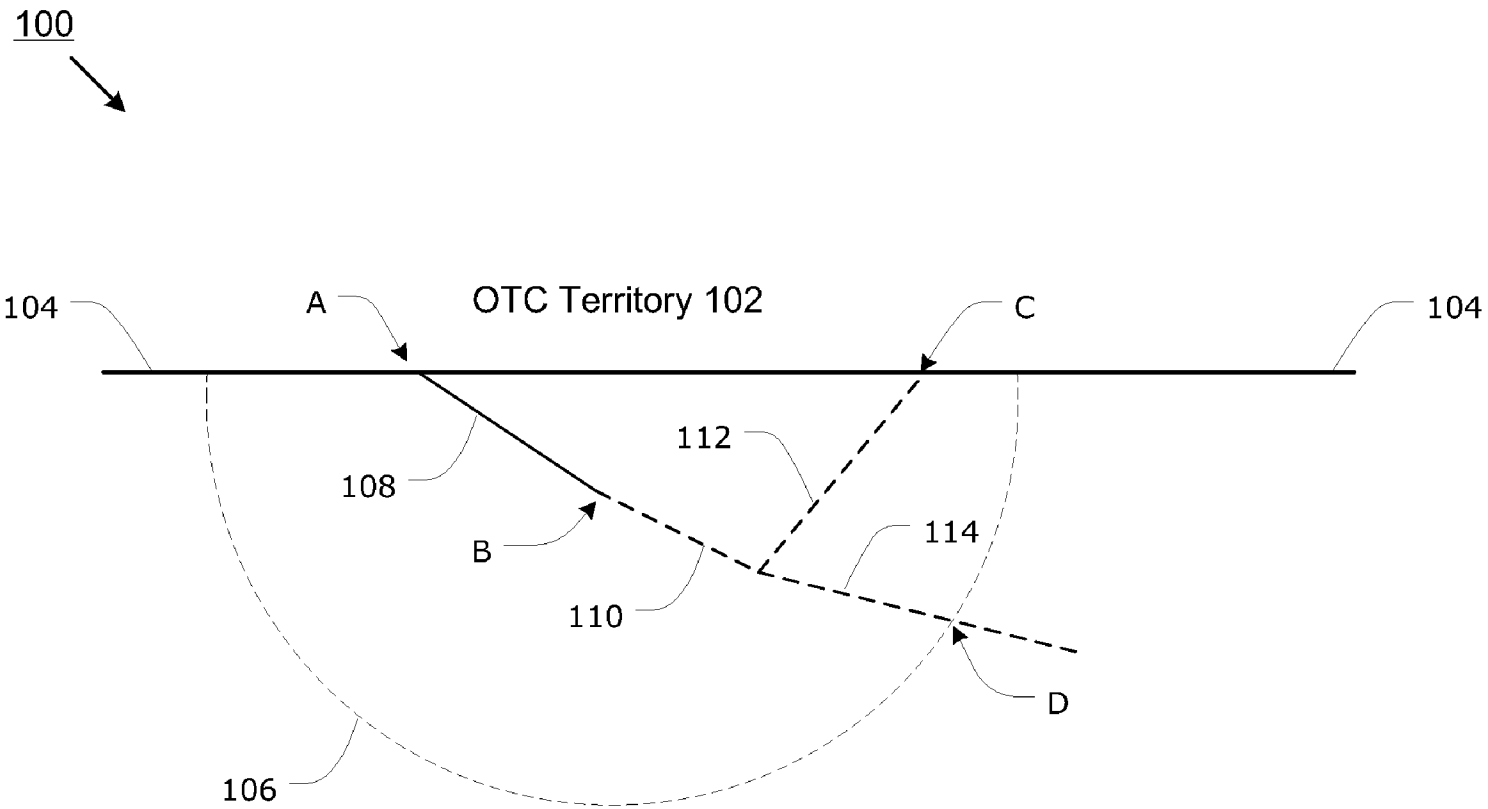
FIG. 1 depicts a region that includes territory that is controlled by a railway operator and spurs that are not controlled by the railway.

FIG. 1 depicts region 100 that includes track. Some of the track, such as trunk track 104, is in OTC territory 102. This territory, and such track, is controlled by the railway operator, hence the ability to "optimize" train control, as defined above. Other track, however, is not controlled by the railway operator. In particular, the spur having portions 108, 110, 112, and 114 is not controlled by the railway operator; rather, it is owned by a private company that is not affiliated with the railroad. Portion 108 of the spur is mapped and portions 110, 112, and 114) are not mapped.

In accordance with the illustrative embodiment of the invention, when a train leaves track that is controlled by the railway, it remains (for a configurable distance of the exit point) in OTC operation in a special Industry Spur Operation (ISO) mode of operation. Once the train operates beyond the configurable distance, the onboard control system downmodes out of OTC operation to a Controlling (Ready) state. The ISO supported region is demarcated by perimeter 106 in FIG. 1.

Figure 2:
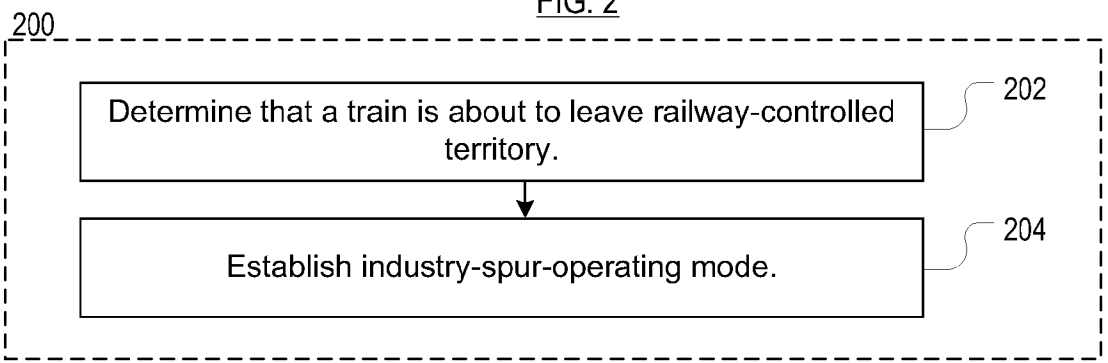
FIG. 2 depicts a method in accordance with the illustrative embodiment of the present invention.

FIG. 2 depicts a flow diagram of the method 200 in accordance with the illustrative embodiment of the present invention. The method provides a special mode of train control that efficiently handles, in a vital manner: (1) transitions out of and back in to controlled territory at designated locations and (2) operation within proximity of the designated locations.

In accordance with operation 202 of method 200, a train determines that it is about to exit railway-controlled territory. Once this determination is made, the train establishes an industry-spur-operating or ISO mode, as per operation 204. This operating mode is supported for a specified distance beyond a point of exit from the railway-controlled territory (e.g., up to perimeter 106 in FIG. 1).

Figure 3:
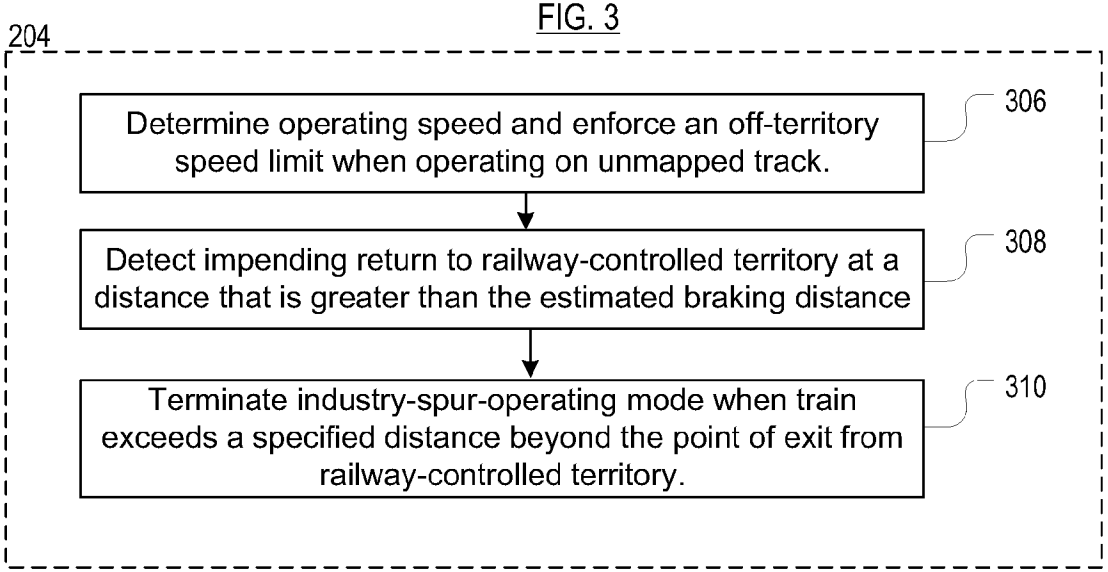
FIG. 3 depicts a method for carrying out an operation of the method of FIG. 2.

FIG. 3 depicts a flow diagram of the sub-operations for operation 204 of method 200. These sub-operations are not practiced in series, per se; rather, they are aspects of operating in the industry-spur-operating mode, in accordance with the present invention.

As per sub-operation 306, operating speed is determined and an off-territory speed limit (typically dictated by operating guidelines) is enforced when operating on unmapped track. In sub-operation 308, an impending return to railway-controlled territory is detected at a distance that is greater than the estimated braking distance for the train. This ensures that the train does not attempt to re-enter controlled territory in an unsafe manner. As per operation 310, there is a cessation of the industry-spur-operating mode when the train exceeds the specified distance beyond the point of exit.

Figure 4:
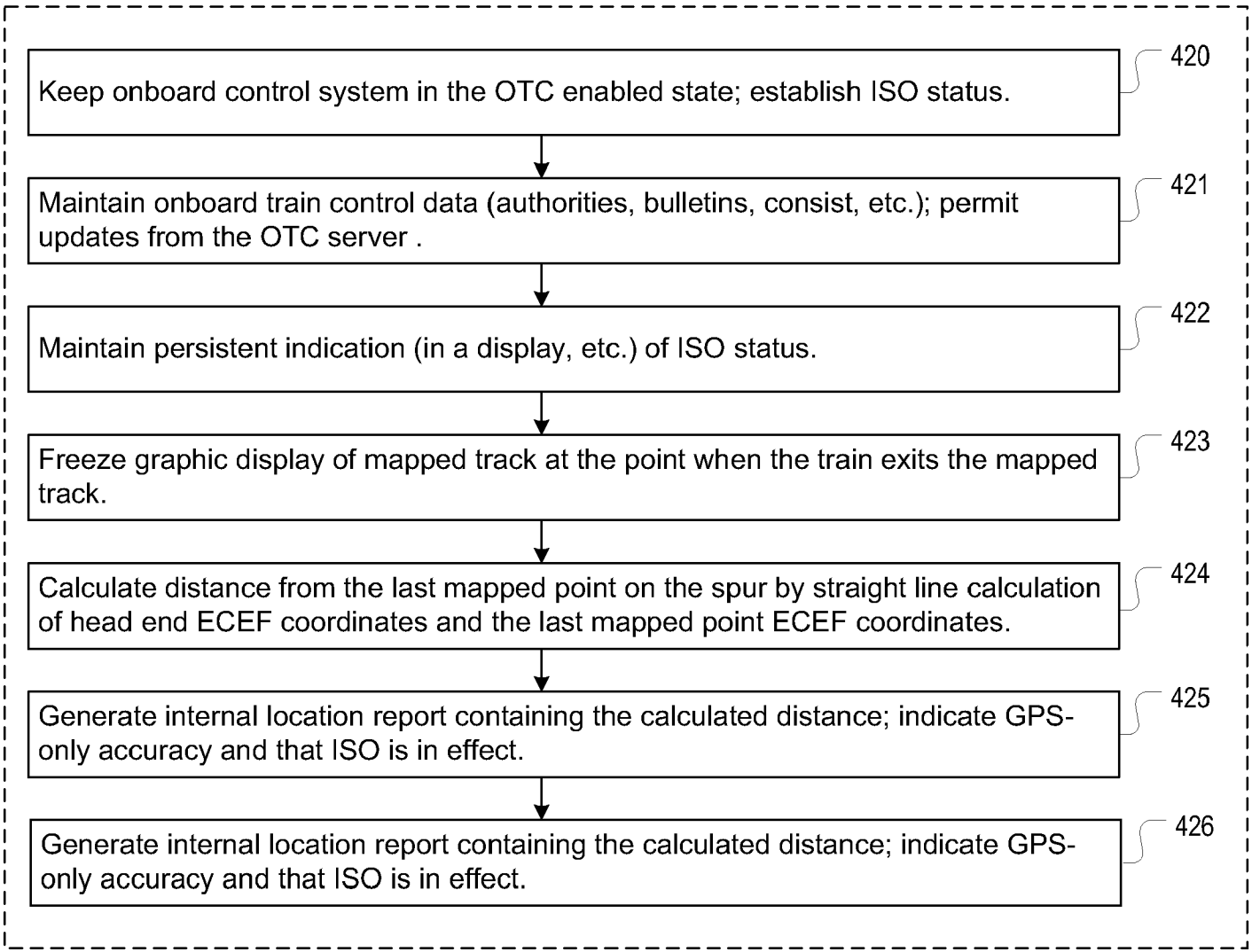
FIG. 4 depicts a first embodiment in application of the methods of FIGS. 2 and 3 wherein a train exits mapped track at a spur while OTC enabled.

FIG. 4 depicts a first embodiment in application of the methods of FIGS. 2 and 3 wherein an OTC-enabled train exits OTC territory through a HT (hand-thrown) switch and operates in an unmapped portion of an industrial spur.

The operations depicted in FIG. 4 and described below apply as the head-end of a train transitions, at point B, from mapped portion 108 of the spur to unmapped portion 110 (see, FIG. 1).

420: The onboard system remains in the OTC-enabled state and a status of "Industry Spur Operation" ("ISO") is established.

421: Onboard train control data (e.g., authorities, bulletins, etc.) is maintained and is updateable from the OTC server.

422: The display shows a persistent indication that "ISO" is in effect.

423: A graphic display of mapped track will be frozen to the point when the train exists the mapped track.

424: Internal location reports are formed to indicate a calculated distance extended from the last mapped point on the spur by straight line calculation of the head-end ECEF and the last mapped point ECEF. ECEF stands for Earth-Centered, Earth-Fixed, and is a Cartesian coordinate system used for GPS. It represents positions as an X, Y, and Z coordinate. The point (0,0,0) denotes the mass center of the earth, hence the name "Earth-Centered." The z-axis is defined as being parallel to the earth's rotational axes, pointing towards north. The x-axis intersects the sphere of the earth at the 0° latitude, 0° longitude. This means the ECEF rotates with the earth around its z-axis. Therefore, coordinates of a point fixed on the surface of the earth do not change, hence the name "Earth-Fixed."

425: Location reports to the OTC server will indicate "GPS only accuracy" and that "ISO is in effect" (for logging).

426: While the train is not near the exit point, the crew will not be "nagged" to attempt to select track as part of a continuing attempt by the location determining system to resolve to track.

Figure 5:
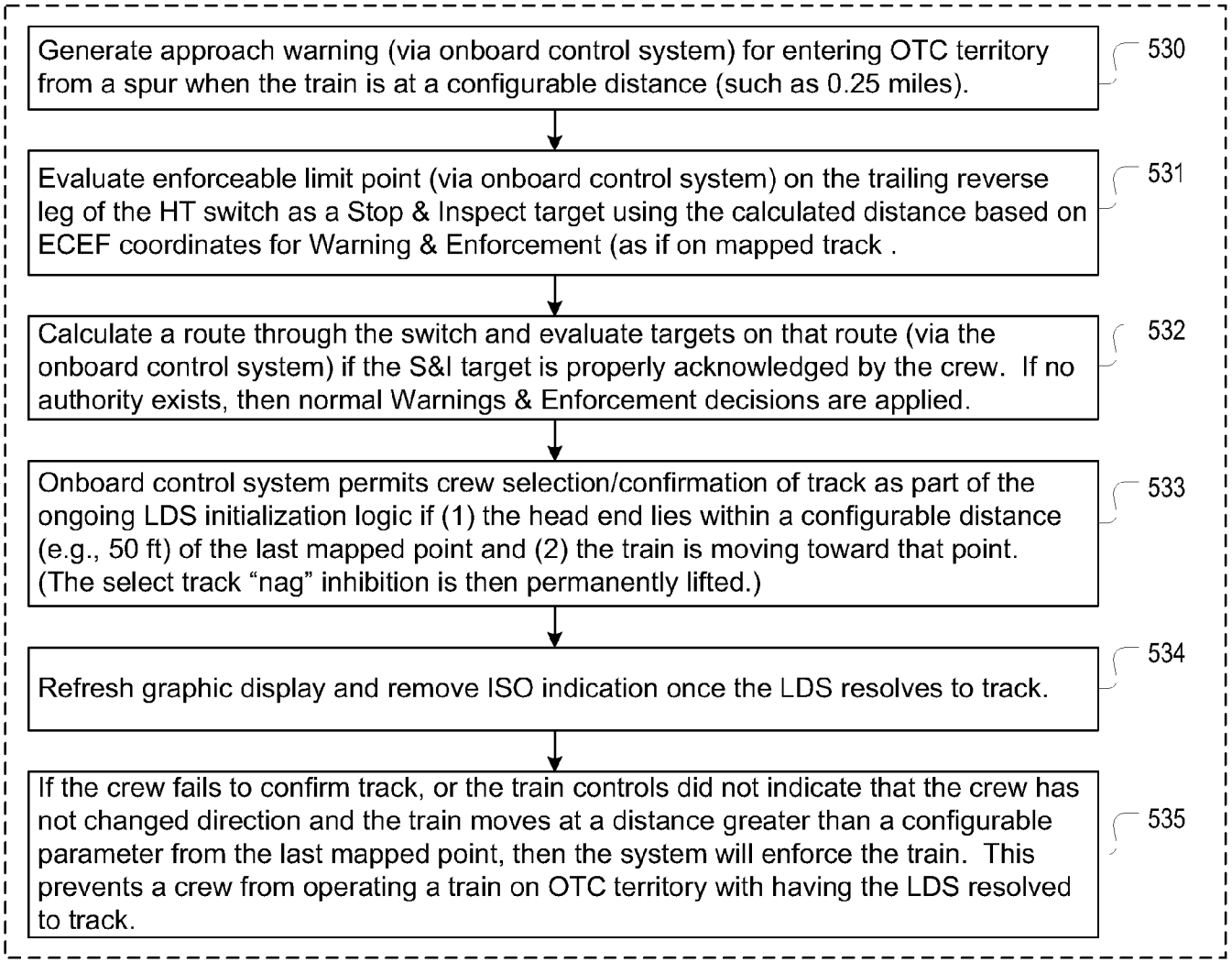
FIG. 5 depicts a second embodiment in application of the methods of FIGS. 2 and 3 wherein a train re-enters controlled territory at an exit spur.

FIG. 5 depicts a second embodiment in application of the methods of FIGS. 2 and 3 wherein an OTC-enabled train in ISO operation re-enters OTC territory at point A (FIG. 1) through an HT switch from which the train originally exited.

The operations depicted in FIG. 5 and described below apply as a train is moving towards the last mapped point B on the spur from which the train exited.

530: The onboard system generates an approach warning for entering OTC territory from an HT spur when it is at a configurable distance (e.g., 0.25 miles).

531: The onboard system evaluates the enforceable limit point on the trailing reverse leg of the HT switch as a Stop & Inspect target using the calculated distance based on ECEF for the purposes of Warning and Enforcement (as if it were on mapped track).

532: If the Stop & Inspect target is properly acknowledged by the crew, the onboard system calculates a route through the switch and evaluates targets on that route. If no authority exists, normal Warnings and Enforcement decisions are applied.

533: If the head-end of the train lies within a configurable distance (e.g., about 50 ft, etc.) of the last mapped point on the spur and the train is moving toward that point, then the system will thereafter permit the crew selection/confirmation of track as part of the ongoing location determination system logic. (The select track "nag" inhibition is then lifted.)

534: Once the location determining system resolves to track, the graphic display will be refreshed and the persistent indication of "ISO" is removed.

535: If, for some reason, the crew fails to confirm track, the train controls did not indicate that the crew has not changed direction and the train moves at a distance greater than a configurable parameter from the last mapped point, then the system will enforce (brake) the train. This prevents a crew from operating a train on OTC territory without having the location determining system resolved to track.

Figure 6:
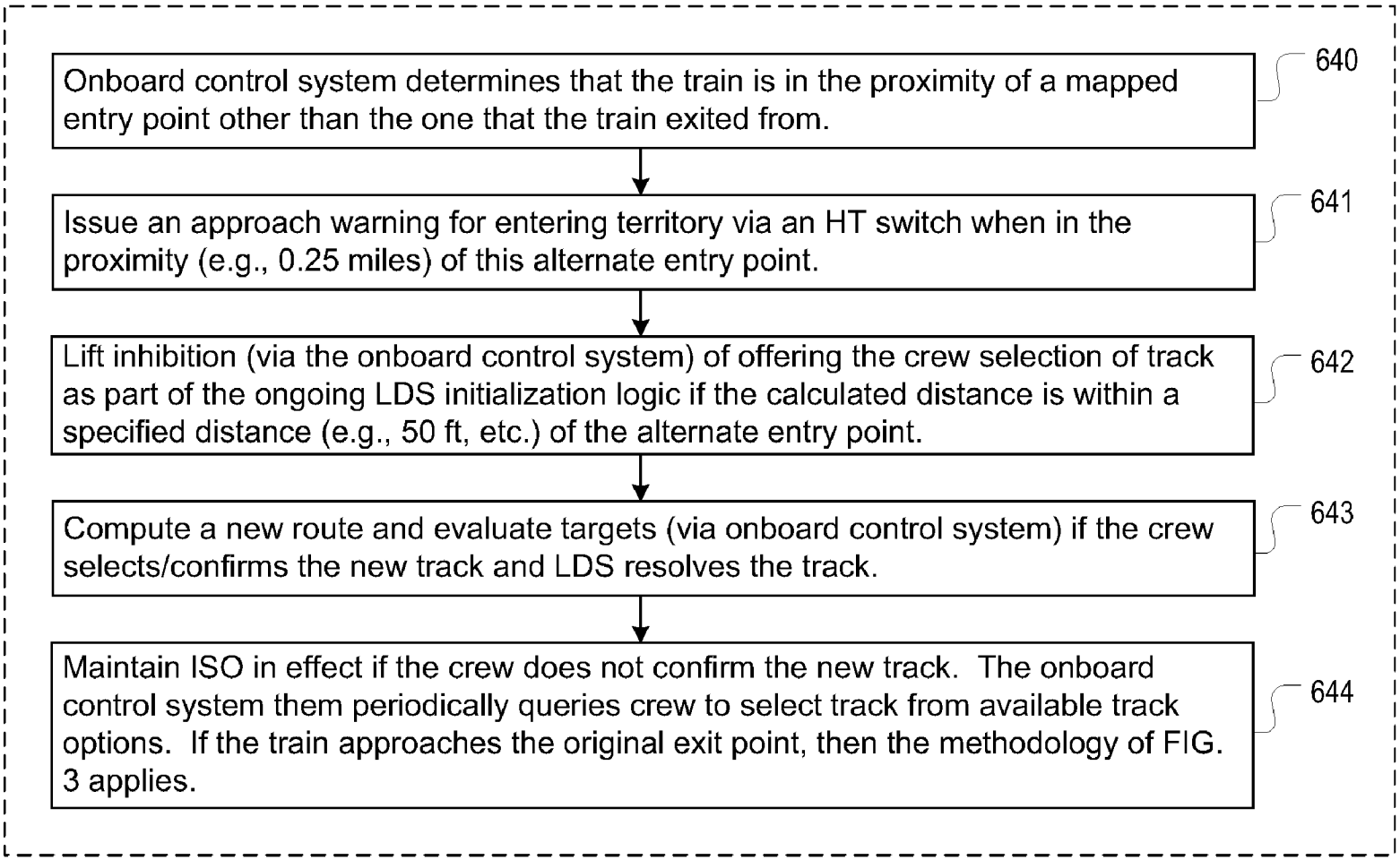
FIG. 6 depicts a third embodiment in application of the methods of FIGS. 2 and 3 wherein a train re-enters controlled territory at a location that is different from the exit spur.

FIG. 6 depicts a third embodiment in application of the methods of FIGS. 2 and 3 wherein an OTC-enabled train in ISO operation re-enters OTC territory at point C through a different HT switch than it originally exited from. This scenario arises in track configurations wherein there are multiple points of entry to the territory in the proximity of the point where the train originally exited mapped track. An alternate point of re-entry to OTC territory will not provide the identical Warnings and Enforcement as if the train re-entered using the spur it originally exited from.

The operations depicted in FIG. 6 apply as the train moves toward the last mapped point on an entry point other than the spur that they exited from.

640: The onboard control system determines that the train is in proximity of mapped (re-) entry point other than the one on which the train originally entered.

641: The approach warning for entering territory via an HT switch is issued when the train is in the proximity (e.g., 0.25 miles, etc.) of this alternative entry point.

642: The onboard system lifts the inhibition of offering the crew selection of track as part of the ongoing location determining system initialization logic if the calculated distance is within some distance (e.g., 50 ft, etc.) of the alternate entry point.

643: If the crew selects/confirms the new track and the location determining system resolves to track, then a new route is computed and targets are evaluated.

644: If the crew does not confirm track, then the system assumes that "ISO" remains in effect. From this point onward, the system periodically queries the crew to select track from available track options. If the train approaches the original exit point, then the operations described in FIG. 5 apply.

Figure 7:
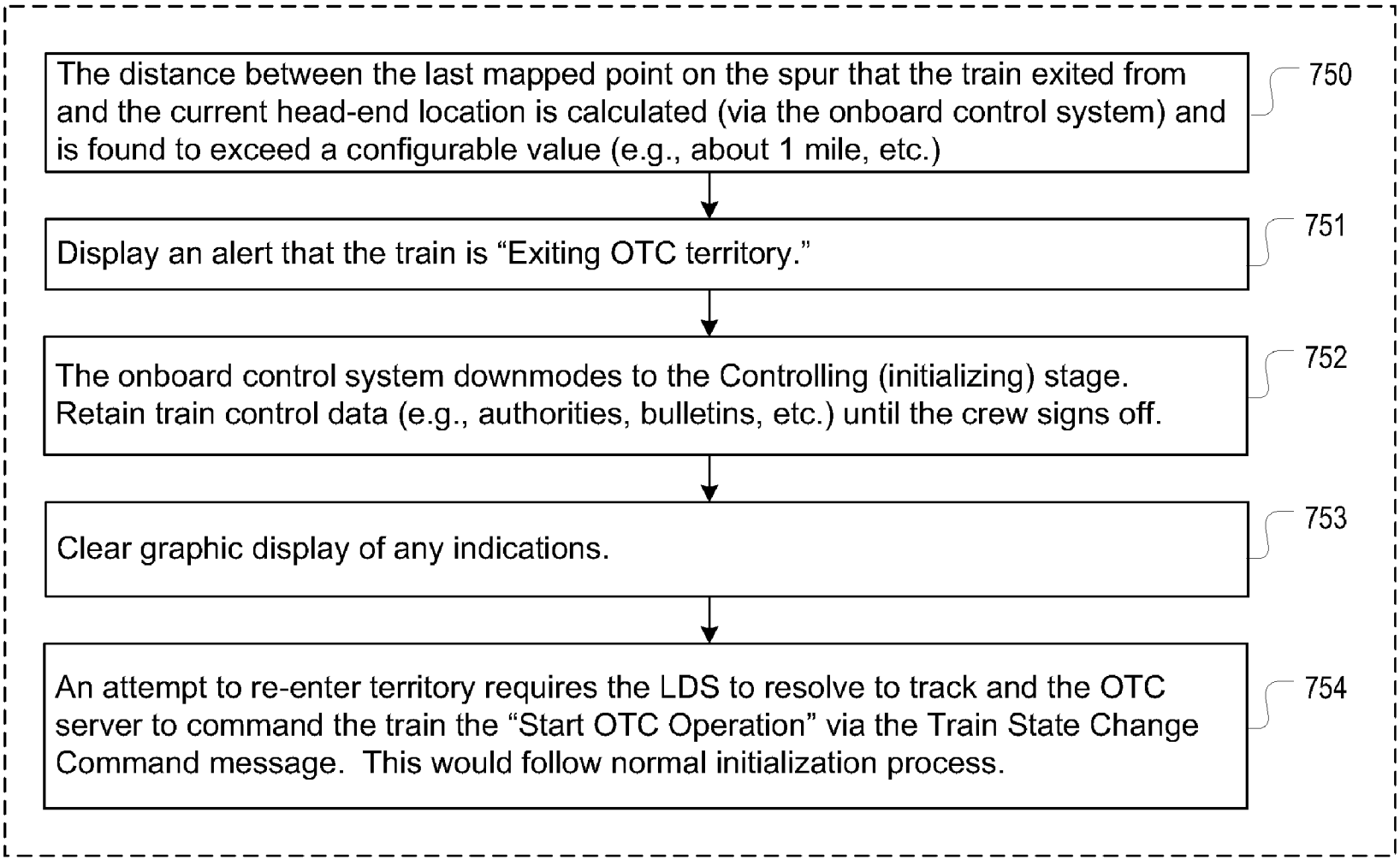
FIG. 7 depicts a fourth embodiment in application of the methods of FIGS. 2 and 3 wherein a train leaves a spur and operates beyond configurable distance.

FIG. 7 depicts a fourth embodiment in application of the methods of FIGS. 2 and 3 wherein an OTC-enabled train in ISO operation is operated beyond a configurable distance from the point at which they exited OTC territory.

The operations depicted in FIG. 6 apply as the train moves significantly away from the last mapped point on the spur from which the train exited OTC territory.

750: The onboard system determines that the calculated distance from the last mapped point on the spur from which the train exited OTC territory and the current location of the head-end of the train exceeds a configurable value (e.g., 1 mile, etc.).

751: An alert is displayed that the train is "Exiting OTC Territory."

752: The onboard system automatically downmodes to the Controlling (Initializing) state. The Train Control data (e.g., authorities, bulletins, etc.) are retained until the crew signs off.

753: The graphic display is cleared.

754: Any attempt to re-enter OTC territory requires that the location determining system resolves to track and further requires that the OTC server command the train to "Start OTC Operation" via the Train State Change Command message. This follows the normal initialization process.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A method for controlling, from an onboard control system, a train that transitions between a railway-controlled territory and an off territory, wherein the method comprises:

determining, by the onboard control system, that the train is about to exit the railway-controlled territory, wherein the onboard control system comprises a track map of the railway-controlled territory and lacks an off-territory track map;

when the train exits the railway-controlled territory, establishing, by the onboard control system, an industry-spur-operating mode of operation for the train; and operating in the industry-spur-operating mode for a specified distance beyond a point of exit from the railway-controlled territory, wherein the industry-spur-operating mode comprises:

determining, by the onboard control system, an operating speed; and enforcing, by the onboard control system, an off-territory speed limit.

2. The method of claim 1 wherein the industry-spur-operating mode further comprises:

detecting, by the onboard control system, an impending return of the train to the railway-controlled territory at a distance that is greater than an estimated braking distance of the train.

3. The method of claim 1 wherein the industry-spur-operating mode further comprises:

ceasing, by the onboard control system, the operating in the industry-spur-operating mode when the train exceeds the specified distance beyond the point of exit.

4. The method of claim 1 wherein the specified distance is configurable in the onboard control system.

5. A method for controlling, from an onboard control system, a train that transitions between a railway-controlled territory and an off territory, wherein the method comprises:

determining, by the onboard control system, that the train is about to exit the railway-controlled territory, wherein the onboard control system comprises a track map of the railway-controlled territory and lacks an off-territory track map;

when the train exits the railway-controlled territory, establishing, by the onboard control system, an industry-spur-operating mode of operation for the train; and operating in the industry-spur-operating mode for a specified distance beyond a point of exit from the railway-controlled territory, wherein the industry-spur-operating mode comprises:

detecting, by the onboard control system, an impending return of the train to the railway-controlled territory at a distance that is greater than an estimated braking distance of the train.

6. The method of claim 5 wherein the industry-spur-operating mode further comprises:

ceasing, by the onboard control system, the operating in the industry-spur-operating mode when the train exceeds the specified distance beyond the point of exit.

7. The method of claim 5 wherein the specified distance is configurable in the onboard control system.

8. A method for controlling, from an onboard control system, a train that transitions between a railway-controlled territory and an off territory, wherein the method comprises:

determining, by the onboard control system, that the train is about to exit the railway-controlled territory, wherein the onboard control system comprises a track map of the railway-controlled territory and lacks an off-territory track map;

when the train exits the railway-controlled territory, establishing, by the onboard control system, an industry-spur-operating mode of operation for the train; and operating in the industry-spur-operating mode for a specified distance beyond a point of exit from the railway-controlled territory, wherein the industry-spur-operating mode comprises:

ceasing, by the onboard control system, the operating in the industry-spur-operating mode when the train exceeds the specified distance beyond the point of exit.

9. The method of claim 8 wherein the specified distance is configurable in the onboard control system.

* * * * *